US005558023A

United States Patent [19]

Senior, III

[11] Patent Number: 5,558,023

[45] Date of Patent: Sep. 24, 1996

[54] ENCLOSED TRANSPORTATION SYSTEM FOR RIDER PROPELLED VEHICLES WITH PNEUMATIC PROPULSION ASSISTANCE

[76] Inventor: Milnor H. Senior, III, 3377 S. Willow Ct., Denver, Colo. 80231

[21] Appl. No.: 462,134

[22] Filed: Jun. 5, 1995

Related U.S. Application Data

[63] Continuation of Ser. No. 174,253, Dec. 28, 1993, abandoned.

[51] Int. Cl.[6] ..... B61B 13/10

[52] U.S. Cl. ..... 104/138.1; 104/124; 104/155; 404/1

[58] Field of Search ..... 104/138.1, 124, 104/126, 155; 105/365; 406/105, 110, 111, 112; 404/1; 52/79.7

[56] References Cited

U.S. PATENT DOCUMENTS

| | | | |
|---|---|---|---|
| 1,053,368 | 2/1913 | Eells | 104/138.1 X |
| 2,296,771 | 9/1942 | Crawford et al. | 104/138.1 |
| 3,090,328 | 5/1963 | Berggren | 104/23.1 X |
| 3,404,638 | 10/1968 | Edwards | 104/155 |
| 3,438,337 | 4/1969 | Edwards | 104/155 X |
| 3,724,691 | 4/1973 | Carstens et al. | 104/155 X |
| 3,797,405 | 3/1974 | Carstens et al. | 104/138.1 |
| 3,859,682 | 1/1975 | Sulkiewicz | 104/138.1 |
| 3,980,024 | 9/1976 | Futer | 105/365 X |
| 3,999,487 | 12/1976 | Valverde | 104/155 X |
| 4,023,500 | 5/1977 | Diggs | 104/138.1 |
| 4,027,596 | 6/1977 | Nardozzi, Jr. | 104/138.1 |
| 4,078,498 | 3/1978 | Futer | 105/365 X |
| 4,458,602 | 7/1984 | Vandersteel | 104/138.1 |
| 4,821,647 | 4/1989 | Powell et al. | 104/138.1 |

FOREIGN PATENT DOCUMENTS

| | | | |
|---|---|---|---|
| 628897 | 11/1961 | Italy | 104/138.1 |
| 159912 | 12/1979 | Japan | 104/138.1 |

*Primary Examiner*—S. Joseph Morano
*Attorney, Agent, or Firm*—Harold A. Burdick

[57] ABSTRACT

A transportation system and method for rider propelled vehicles, such as bicycles, is disclosed, the system including a covered structure having a surface for movement thereover of the vehicle. Fan units are provided to move air through the structure in a direction and at a selected velocity sufficient to aid movement of a vehicle through the structure. The structure is covered and is configured so that relative elevations of the surface of the structure between entrance thereto and exit therefrom are selectable independently from ground grades found at the site of system installation and thus with minimum disruption of the site.

20 Claims, 4 Drawing Sheets

ENCLOSED TRANSPORTATION SYSTEM FOR RIDER PROPELLED VEHICLES WITH PNEUMATIC PROPULSION ASSISTANCE

This application is a continuation of U.S. patent application Ser. No. 08/174,253 filed on Dec. 28, 1993 and entitled "Transportation System and Method For Rider Propelled Vehicles" now abandoned.

FIELD OF THE INVENTION

This invention relates to transportation modes, and, more particularly, relates to transportation systems and methods for rider propelled vehicles such a bicycles.

BACKGROUND OF THE INVENTION

The movement by various agencies to plan and provide for transportation systems which encourage and accommodate multiple modes of urban travel (multi-modal transportation system planning), including private motor vehicular, self-propelled (such as bicycles), pedestrian, and mass transit modes and corridors, has gained momentum in recent years. One key element of such planning is the provision of multi-nodal systems, that is, transportation systems that provide links between the various modes of movement in the system (for example, the provision of central mass transit stations linked to both major thoroughfares and at the hubs of an urban bus system).

Left out of much of this planning, however, has been consideration for linking the so called "bike-way" element of such plans into the multi-nodal system in such a way as to encourage the use of rider propelled (non-motorized) transportation as a primary mode of transportation in the system, rather than as a mere means of entertainment or recreation. In particular, such bikeways are typically not provided in sufficient number, with sufficient separation from vehicular facilities or with sufficient links to other modes to make their use practical for commuting, access to shopping facilities and the like. This has been due, in part, to the expense and/or difficulty of acquiring ways of access (easements) for bike-way construction, particularly in more congested and/or long developed urban areas, and to the costs of construction and maintenance.

Moreover, little consideration has been given to providing bike-way systems which lessen the physical impacts inherent in use of such a system, including weather related impacts and the physical exertion necessary to move over longer distances, such systems being exposed to the elements and typically following whatever terrain happens to be available for the facility.

It is apparent that for such non-motorized modes of transportation to become primary in use, and for urban areas to thus receive the benefits of reduced reliance on the private automobile, improvement of the bike-way element of multi-modal transportation systems is necessary. However, for such improvements to be adopted, the costs associated with an improved bike-way element must be reasonably related to the projected benefits, preferably adding little if any expense to current per mile aggregate acquisition, construction and maintenance costs.

SUMMARY OF THE INVENTION

This invention provides an improved transportation system for rider propelled vehicles, the system being especially well adapted for urban use and for urban systems, though use can as well be made of the herein disclosed system for non-urban travel.

The transportation system requires less easement area to install, is adapted for use in congested urban areas, can be sited independently from streets and highways, is protected from adverse weather conditions, and is provided with multiple means calculated to lessen the physical exertion necessary for movement of a vehicle therealong. It is projected, that with increased use of the system, the overall cost of this system, relative to acquisition, installation, and maintenance costs of existing types of bike-way systems and other transportation modes in an urban transportation system, will have a beneficial impact on the overall transportation budget in an urban area where it is utilized.

The system includes a passage structure for movement therethrough of user propelled vehicles. Air movers are mounted on the structure to provide air flow at a velocity and in a direction to aid movement of a vehicle while yet retaining a substantially constant overall air pressure in the passage structure. The surface, or pathway, over which the vehicles move is covered to keep out naturally occurring precipitation and or winds, and the structure is preferably elevated to provide selected grade characteristics independent of the grade at the site of installation.

Multiple passageways are provided in the structure, each passageway having a different, substantially opposite, air flow direction thereby accommodating two way traffic. The structure is preferably modular in design.

It is therefore an object of this invention to provide an improved transportation system for rider propelled vehicles.

It is another object of this invention to provide an improved transportation system that requires less easement area to install, is adapted for use in congested urban areas, can be sited independently from streets and highways, is protected from adverse weather conditions, and is provided with multiple means calculated to lessen the physical exertion necessary for movement of a vehicle therealong.

It is still another object of this invention to provide a transportation structure for rider propelled vehicles which includes a covered pathway throughout the full extent of the distance between point of departure and destination.

It is yet another object of this invention to provide a transportation structure which is elevated for the purpose of controlling grade of a rider surface without disrupting grade of the terrain at a site of installation.

It is still another object of this invention to provide a transportation system which includes a passage structure including a surface for movement thereover of the vehicle and means for moving air through the passage structure in a direction and at a velocity sufficient to aid movement of the vehicle through the passage structure while retaining a substantially constant overall air pressure in the passage structure between an entryway thereto and a way of egress therefrom.

It is yet another object of this invention to provide a transportation system for aiding movement of rider propelled vehicles including a covered structure having first and second passageways and a surface for movement thereover of the vehicles.

It is still another object of this invention to provide a transportation system for aiding movement of rider propelled vehicles which includes a vehicle passage structure which is comprised of a plurality of modular passage, or tunnel, segments.

With these and other objects in view, which will become apparent to one skilled in the art as the description proceeds, this invention resides in the novel system, construction, combination and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
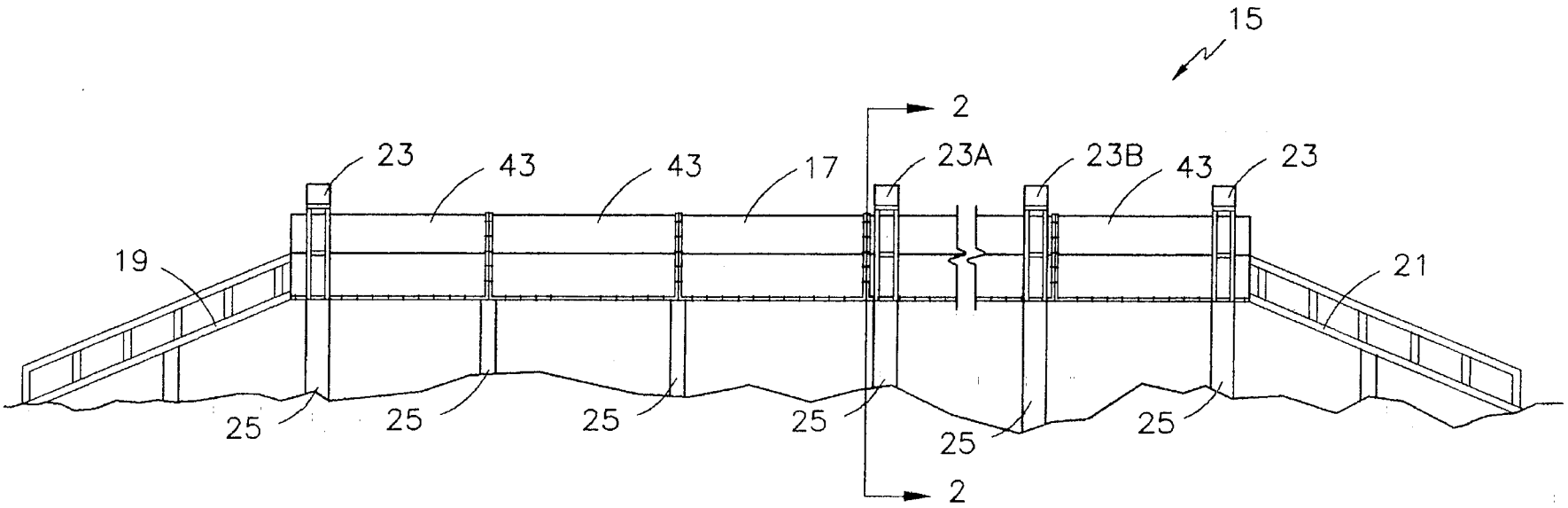
FIG. 1 is a side view illustrating diagrammatically the system of this invention.

FIG. 1 is an illustration of the transportation system 15 of this invention erected on a site having varied terrain (the system of this invention as illustrated in FIG. 1 is, like any bike-way system, intended to cover substantial distances, certainly in excess of 1000 meters in any given segment, and is elevated for grade control and for siting considerations, as more fully discussed hereinafter, and not merely an overpass structure for example). While the system of FIG. 1 is shown to be elevated, elevation is but one of the improvements discussed herein and need not be utilized in every application.

System 15 includes passage structure, or tunnel, 17 providing a pathway for rider propelled vehicles, such as bicycles. Access ways 19 and 21 provide rider entry into and egress from structure 17. Air movers, or fan units (preferably vane axial blower fans), 23 are beneficially provided to create air flow in the direction of vehicle movement (one or two way movement) through structure 17, the air flow being of a velocity sufficient to aid movement of the vehicle. While top-mounting of the fan units is shown, the fan units could be mounted at grade with appropriate ducting and allowance for duct system losses.

Risers 25 (made of concrete, steel, wood or composite material supporting piers) support structure 17 and are of lengths selected so that the grade of the structure can be controlled without changing grade of the terrain at the site of installation. While a multi-legged riser unit 25 is shown, a pedestal type riser could also be utilized where right-of-way acquisition is even more severely limited.

Figure 2:
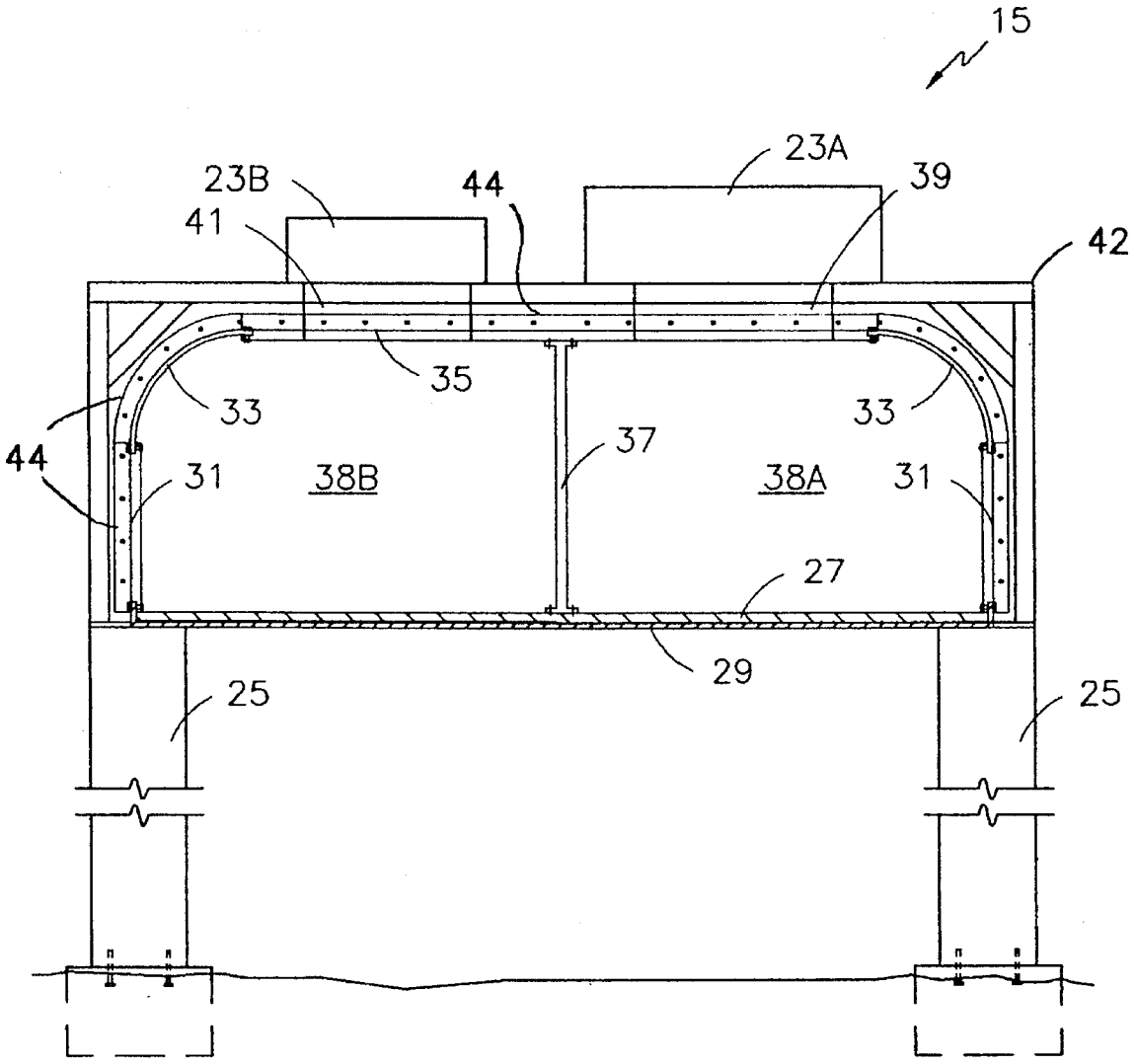
FIG. 2 is a sectional view taken through section lines 2—2 of FIG. 1.

As shown in FIG. 2, structure 17 includes vehicle support surface 27 (poured tartan, concrete, asphalt, or the like) maintained in foundation element 29 attached to side walls 31. Light transmitting wall panels 33 (transparent or translucent) are supported on walls 31 and in cover structure 35. It should be appreciated that a single unitary (for example, molded or extruded) wall could be provided in place of the multi-unit structure formed by walls 31, 33 and 35. Tunnel divider wall 37 (preferably selectively positionable, from left to right in the Figure) is maintained between cover structure 35 and surface 27 in the structure to divide structure 17 into discrete passageways 38A and 38B (though any number of passageways and/or lanes could be provided). The overall width of support surface 27 is selected depending on desired lane capacity as well as siting of the structure (for example, the overall structure could be wide enough to allow erection of the system over existing street right-of-ways thereby implicating no land acquisition to site the structure).

Fan units 23A and 23B are provided with ducting 39 and 41, respectively, for supply and return air functions within each passageway to provide air flow in a direction corresponding to the intended direction of travel of vehicles through each passageway (i.e., in opposite directions). The fan units are appropriately supported on support structure 42 (for example, an ironwork frame support) which in turn are mounted on risers 25.

Walls 31, 33, 37 and cover structure 35 may be constructed from common building materials such as structural steel shapes, concrete, and plastic such as Plexiglass, Lexan, or various types of recycled rigid plastic building materials (molded, blown, or heat deformation techniques may be utilized), with structure 17 preferably being assembled of discrete, transportable tunnel modules (43 in FIG. 1) fabricated off-site. For this purpose, each of wall segments 31 and 33 and cover structure 35 include flanges 44 at their opposite ends (both ends) to facilitate interconnection of the modules, with the interconnections being appropriately sealed to preserve air flow. The interior of structure 17 should be aerodynamically smooth and, for purposes of the following disclosure, the smoothness of the surface is assumed to be approximately the same as commercial metal ductwork.

To properly provide for the desired air flow velocity in the passageways (between about 10 and forty miles per hour, and preferably about 30 miles per hour) proper fan capacity for fan units 23 must be determined. This is done by first determining the equivalent diameter of a circular duct by calculating the actual cross sectional area of half of structure 17 (i.e., of passageway 38A or 38B). The resulting area is then used in the formula for the area of a circle. The formula is then solved for radius and the equivalent diameter of a circular duct is thus twice the radius (the equivalent diameter referred to is for one half of the area of the interior of structure 17).

Fan capacity calculations must be corrected for the actual density of air at the installation site. For example, standard density of air at sea level is 0.075 lbm./ft. while the density of air at one mile above sea level is about 0.062 lbm./ft. Also necessary for the air calculations is velocity pressure (VP), the pressure exerted by flowing air due to the velocity. The units for velocity pressure are inches of water gage (in. w.g.).

The airflow required to produce a desired velocity in one passageway is calculated from the standard air formula, quantity (in ft.$^3$/min.)=area (in ft.$^2$)×velocity (in ft./min.).

Also needed for calculations of necessary fan capacity for a given installation is the friction in the passageway (i.e., the resistance to air flow that must be overcome by the pressure produced by the fans). The friction loss ($H_f$) is measured empirically as follows:

$$H_f=0.0307\times(\text{velocity (ft./min.)})^{0.533}/(\text{quantity(ft.}^3\text{/min.)})^{0.612}$$

This empirical formula is based on standard air of 0.075 lb./ft.$^3$ density flowing through clean, round, galvanized ducts with an equivalent sand grain roughness of 0.0005 ft.$^{(2)}$.

All smooth surfaces have peaks and valleys. The mean distance between these high and low points is the absolute roughness $\epsilon$. The relative roughness $\epsilon/D$ of the surface in a conduit is the absolute roughness divided by the effective diameter. Because of the small value for $\epsilon$ (0.000005 ft. for very smooth surfaces to 0.01 ft. for very rough surfaces) and the very large value for D, the relative roughness of the tunnel will be low. Smoother materials are preferred and will lower the aerodynamic resistance resulting in lower energy usage and operating cost.

The interior of structure 17 should employ as many curved walls as possible since round ducts are more effective for flowing air as compared to irregular cross sections.

Tunnel length for 1" w.g. pressure drop is used in determining the spacing of fan units 23. This value represents the length of structure 17 (with a friction loss of $H_f$) that will cause a pressure drop in the air of 1" w.g. It is calculated by:

$$\text{Tunnel length (ft.)}=1/(H_f \times VP)$$

Figure 5:
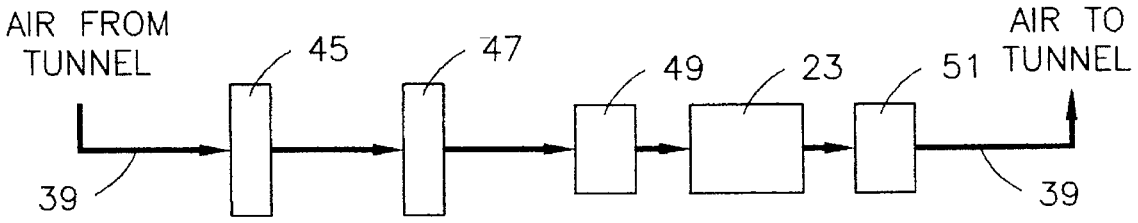
FIG. 5 is a block diagram of air handling systems utilized in this invention.

Since it may be desirable to provide air filtration, heating and/or cooling, estimates of the pressure losses associated with ducting 39/41 to remove the air from the tunnel, filter the air, heat or cool the air, and return the air to the tunnel must be accounted for. Assuming, for example, a design velocity for air in the ducts of 3,500 ft./min. (a normal velocity for this application), the design pressure drop through filter 45 (FIG. 5) would be about 0.50 in. w.g. As debris collects on the filter media, the pressure drop through the filter will increase. However, automatic filters are available that advance new media into the air stream when the pressure drop exceeds a set point, resulting in a reasonably constant pressure drop.

The design pressure drop through the heating and cooling equipment 47 would be about 2.00 in. w.g. This is a reasonable value and is obtained by using equipment with large cross sectional areas to minimize the pressure drop. Equipment with smaller cross sectional areas would cost less initially but would have higher pressure drops resulting in higher pressures required from the fans and thus higher operating cost.

An additional 2.00 in. w.g. of pressure drop approximately should also be foreseen for losses that will occur because of the ducts and elbows necessary to remove the air from the tunnel and return it to the passageways of structure 17.

Optional fan inlet and fan discharge silencers 49 and 51 are provided to offset noise created by high horsepower vane axial fans. Specific selection of industrial grade silencers can be made after noise data for the selected fans are obtained. All major fan manufacturers provide the necessary noise data for selection of appropriate silencers.

Figure 3:
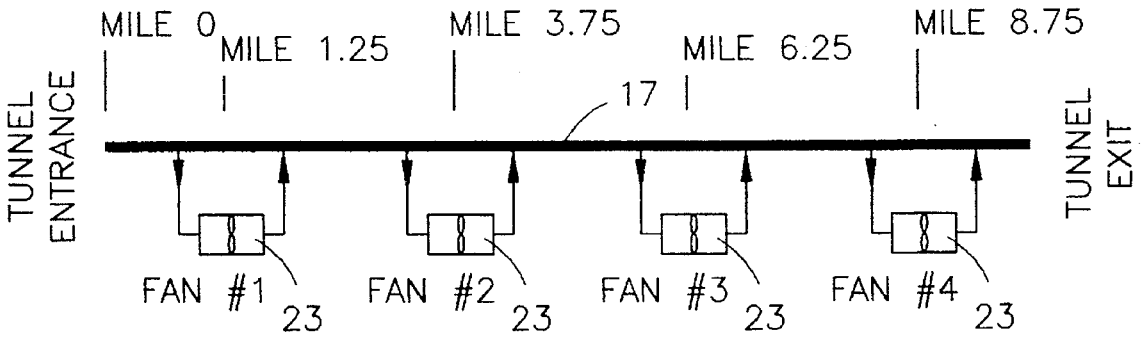
FIG. 3 is a block diagram showing spacing of air movers advantageously used in the system.

The velocity pressure of the air in the system shown in FIG. 3 is added to the static losses to obtain total pressure (total pressure=static pressure+velocity pressure.) Total pressure is required for sizing the fan units 23.

Figure 4:
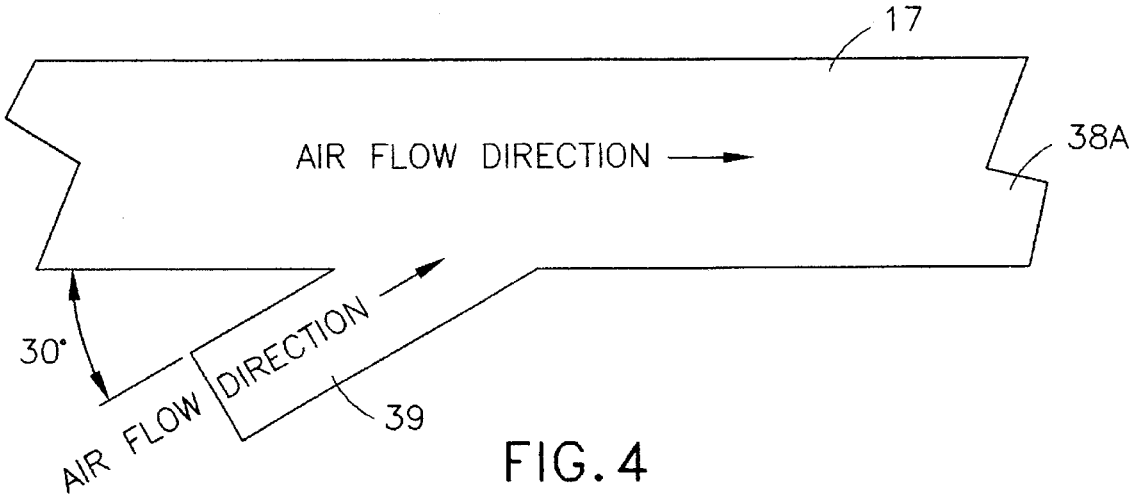
FIG. 4 is a diagram illustrating branch angles for air inlet.

Turning to FIG. 4, each fan unit 23 has two duct connections to a passageway of passage structure 17, one for supply air to the fan and one for return air to the passageway. FIG. 4 shows a typical branch connection for a duct returning air from a fan to the passageway. The connection for a duct supplying air to a fan from the passageway would appear the same except for the directions of the air flow. Both supply and return connections should be covered with heavy wire mesh to protect riders.

The branch connection from the fan to the passageway could be made into the vertical side walls 31 of the structure 17 or cover structure 35. The section of structure 17 where the connection is made would need to be constructed from a more durable material and/or reinforced or supported. Branch connections should preferably have a minimum angle between the passageway and branch duct (about 30° is practical). This will help to minimize pressure drop and to maintain air flow inside the passageway in the desired direction.

Duct sizing necessary for the design velocity is calculated by:

$$\text{area (ft.}^2\text{)=air quantity (ft./min)/air velocity (ft./min.)}$$

Since the branch duct from (or to) the fan units connects with structure 17 at an angle, the area of the opening in the walls will be larger than the cross-sectional area of the duct. This area is calculated by:

$$\text{area in tunnel wall (ft.}^2\text{)=area in duct (ft.}^2\text{)/cos(entry angle)}$$

The width of the opening in the tunnel wall is calculated by:

$$\text{width (ft.}^2\text{)=area (ft.}^2\text{)/tunnel wall height (ft.)}$$

Figure 7:
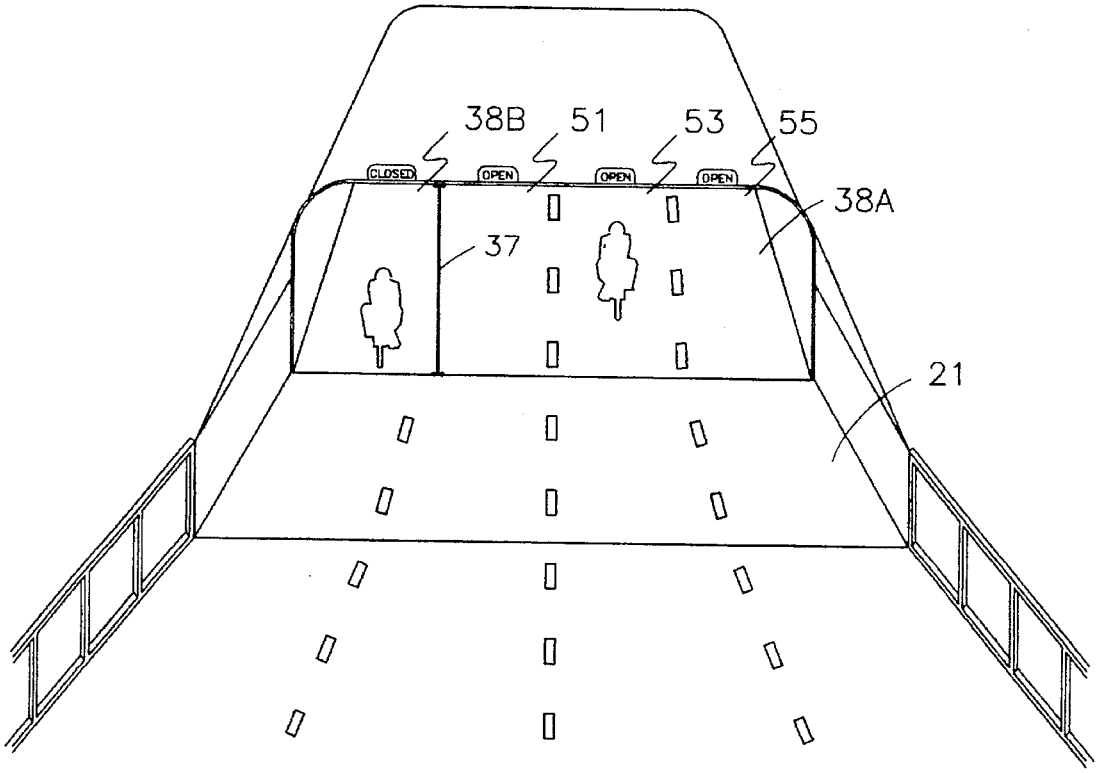
FIG. 7 in a diagrammatic illustration of a larger multi-lane system in accord with this invention.

In this section of the disclosure, the requirements for fan units 23 for one lane in a passageway (as shown in FIG. 7 multiple lanes may be provided in a single passageway 38A or 38B) are developed. One fan system per lane is beneficial because of the size availability of standard industrial vane axial fans. While larger sizes are available, they involve a higher amount of custom design and engineering by the suppliers. It is felt that larger numbers of smaller fans will allow single fans to be taken out of the system for maintenance or repair without major impact on the overall system operation.

Once the air quantity requirements for fan units 23 are obtained from the calculations set forth hereinabove, the performance characteristics for a single fan unit 23 (the maximum air pressure that the fan can develop) is determined. The system loss pressure is subtracted from the maximum pressure and the resulting pressure is the amount that is available to overcome the friction loss in the tunnel (tunnel losses (in. w.g.)=maximum pressure-system losses).

The equivalent length of tunnel that will use the available pressure is calculated by:

$$\text{length (ft.)=available pressure (in. w.g.)}\times\text{length for 1" drop (ft./1 in. w.g.)}$$

The fan efficiency is read from the fan performance chart. The fan brake horsepower is calculated by:

$$\text{fan power (bhp)=density correction}\times\text{quantity}\times\text{static pressure/(efficiency}\times 6{,}356)$$

By way of example, for a ten mile system 15 shown in FIG. 3 and installed in Denver, Colo. (approximately one mile above sea level), having a structure 17 width of 25 feet, wall height of 10 feet to a cover structure peak of 13 feet (full cross-sectional area of 325 square feet), and which is designed for an air velocity in a passageway of 30 miles per hour (2,640 feet per minute) where normal wall friction losses are expected (a friction factor of 0.000730785 VP per foot of tunnel length, and tunnel length for 1" w.g. drop of 3,787 ft.), a duct design velocity of 3,500 ft./min. with fan units 23 having a 214,500 ACFM capacity and spaced at 2.5 mile intervals would be required for a single passageway lane (this assumes air handling system losses of about 4.5 in. w.g.). An initial fan unit 23 at each tunnel entrance (as shown in FIG. 1) or branch connection (as shown in FIG. 6) of similar capacity, while not shown in FIG. 3, is required in most applications.

It would be preferable to interpose between ducts 39/41 and fan units 23 vibration isolation joints to minimize vibration translation from the fans to structure 17. Further, where fans are mounted above the structure 17, extensive effort should be made to further isolate vibration (for example, by mounting units 23 on a separate platform above structure 17). For side entry, fan units 23 could be mounted at grade on appropriate pads.

For fan units 23 dedicated to additional lanes of a passageway (where plural lanes are used as shown in FIG. 7 for passageway 38A having lanes 51, 53 and 55), such units should be spaced equally over the distance to be covered by the lane and between the fan units of an adjacent lane (i.e., so that fan units of adjacent lanes are staggered over the distance to be covered by structure 17). This will provide even distribution of air velocity along the entire length of the multi-lane passageway, avoiding "dead spots" of reduced air velocity in areas between fan inlets and discharges. Even spacing of fans along the entire length of structure 17 helps to maintain a substantially constant overall air pressure along the entire length of the passageway.

Figure 6:
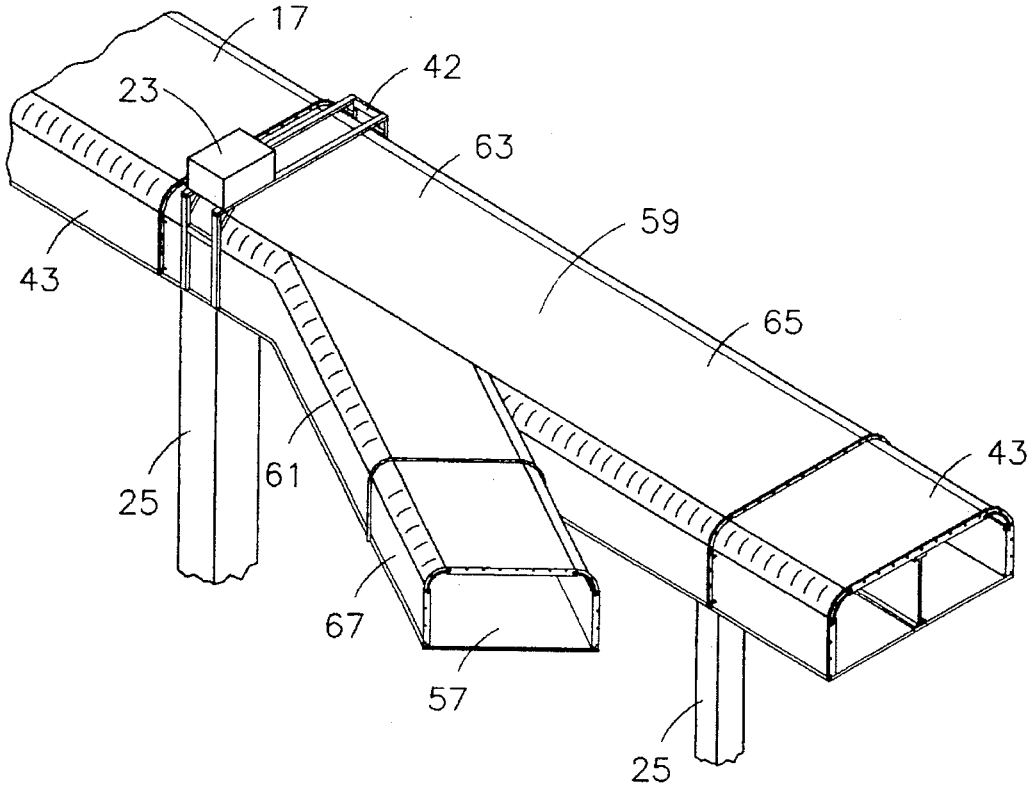
FIG. 6 is an illustration of a medial entrance to or exit from the system.

Turning to FIG. 6, an intermediate access way 57 (an intermediate entryway is shown, though ways of intermediate egress may also be provided) to structure 17 enters at the smallest safe angle possible (to minimize pressure drop at the opening) into a passageway of structure 17. For such intermediate access ways, it is preferable to minimize exit and entrance size (small as possible), maximize friction in the entrances and exits (i.e., to provide a high resistance to air flow into the intermediate access ways, for example by choice of intermediate access way wall materials and/or curvatures and/or angles of entrance and exits). In addition a high pressure wind curtain system could be utilized to minimize loss of system air. Since some loss of air at the site of such intermediate access ways is to be expected, an additional fan unit 23 may be required immediately adjacent to the entry or exit point.

As shown in FIG. 6, for a modular system, a special intermediate module 59 is provided having access way angle entry portion 61, and tunnel portions 63 and 65 (a y-branch type of structure). Module segments 43 and ramp modules 67 are connected to provide the desired structure at the site of installation.

As may be appreciated from the foregoing, an improved transportation system, structures and methods are provided for rider propelled vehicles, the system being configured to encourage use of such vehicles as a primary mode of transportation.

What is claimed is:

1. For use in a transportation network including at least one of streets and paths, a transportation system for aiding movement of a rider propelled vehicle also movable by the rider over the transportation network, said system comprising:

an open sided passage structure defined by first and second spaced wall sections and a covering section opposite an open side of said passage structure between said wall sections, said wall and covering sections formed of non-cementitious plastic material, said passage structure defining at least a first entryway and at least a first way of egress at opposite ends thereof for vehicle entrance into said system from the transportation network and vehicle exit from said system to the transportation network, respectively;

a surface having a width sufficient to span said space between said wall sections and extending from one node in the transportation network to another node in the transportation network, said surface for movement thereover of the vehicle;

means for securing said open sided passage structure over said surface with said surface at said open side; and air moving means supported adjacent to but not supported by said passage structure and connected with said passage structure for moving air through said passage structure in a direction and at a velocity sufficient to aid movement of the vehicle through said passage structure while retaining a substantially constant overall air pressure in said passage structure between said entryway and said way of egress.

2. The system of claim 1 wherein said air moving means includes conditioning means for at least one of filtering, heating and cooling said air.

3. The system of claim 1 wherein at least a part of one of said wall sections of said passage structure is made of light transmitting material.

4. The system of claim 1 wherein said air moving means has a capacity sufficient to cause average air flow velocity of between about ten and forty miles per hour.

5. The system of claim 1 wherein said passage structure includes at least one intermediate opening therein between said first entryway and said first way of egress, said system further comprising an intermediate access way structure positioned angularly relative to said passage structure and having first and second access openings for ingress and egress therefrom, said intermediate access way structure being connected with said passage structure with one of said access openings corresponding to said intermediate opening of said passage structure, the other of said access openings being accessible to vehicles from the transportation network.

6. The system of claim 1 wherein said passage structure includes a plurality of modular segments each secured over a part of said surface and being connected end to end to form said passage structure.

7. For use in a transportation network including bicycle pathway surface, a transportation structure for bicyclists configured to extend along the surface a distance from a point of departure to a destination over varied terrain, said structure comprising:

cover means for shielding the surface from naturally occurring precipitation, said cover means established by a plurality of interconnectable modules, each module having an open side and opposite open ends and being formed of non-cementitious plastic material, each module comprising independently formed first and second side wall sections and a cover section with each of said sections having interconnecting means for sealably assembling said module with said cover section between said first and second side wall sections, each of said sections including at least a first connecting means positioned so that after module assembly said first connecting means of each of said sections is adjacent to one of said open ends of said module for connection to an adjacent module at an open end thereof, each of said side wall sections including means for anchoring said module adjacent to the surface with the surface at said open side of said module; and at least a first entryway and at least a first way of egress for bicycle entrance into and exit from, respectively, said structure from or to the transportation network.

8. The transportation structure of claim 7, further comprising elevating means having the pathway defined thereat and connected with said cover means and in contact with the terrain when said structure is installed for selectively establishing grade characteristics, including lack of grade, of the surface between said entryway and said way of egress independently from terrain grades found at a structure installation site.

9. The transportation structure of claim 8 wherein said elevating means includes a plurality of risers, length of different ones of said risers between the surface and said terrain being selected at different locations along said distance so that said grade characteristics of the surface is substantially said lack of grade in direction of travel along most of said distance.

10. The transportation structure of claim 7 wherein said cover means is configured to shield from both naturally occurring wind and said precipitation.

11. The transportation structure of claim 7 wherein said distance is in excess of a thousand meters.

12. The transportation structure of claim 7 wherein each of said first and second side wall sections includes independently formed upper and lower portions with each of said portions having interconnecting means for sealable assembly of said wall section, said lower portion having said means for anchoring said module thereat, and said upper portion defining an angular transition between said lower portion and said cover section when said module is assembled.

13. The transportation structure of claim 12 wherein said upper sections of said side wall portions are made of one of transparent and translucent material.

14. The transportation structure of claim 7 wherein said first connecting means are configured so that said cover means when assembled from said modules has a substantially smooth interior surface.

15. The transportation structure of claim 7 wherein at least one of said modules includes an intermediate opening between said open ends and second connecting means at said intermediate opening for connection to an adjacent module at an open end thereof, said transportation structure further comprising an intermediate entryway or way of egress leading to said intermediate opening.

16. A transportation system for aiding movement of rider propelled vehicles comprising:

a covered structure including first and second passageways and at least three vehicle lanes defined at a surface for movement thereover of the vehicles, said passageways including at least first and second access ways for vehicle entrance into and exit from said passageways, said covered structure including selectively positionable divider means for defining said first and second passageways, said divider means being movably positionable between selected ones of said lanes; and air moving means mounted with said covered structure for moving air through said first passageway in an overall flow direction from said first to said second access way and for moving air through said second passageway in an overall flow direction from said second to said first access way, said air moving means having capacity to cause air flow velocity in said flow directions in said passageways sufficient to aid movement of the vehicles traveling through said passageways in said flow directions.

17. The system of claim 16 wherein said air moving means includes conditioning means for at least one of filtering, heating and cooling said air.

18. The system of claim 16 wherein said air moving means has a capacity sufficient to cause average air flow velocity in said flow directions of between about ten and forty miles per hour.

19. The system of claim 16 wherein said covered structure includes a plurality of modular tunnel segments each having a part of said surface thereat and openings at opposite ends thereof, said tunnel segments being connected end to end to form said covered structure and said surface thereof.

20. The system of claim 19 further comprising at least one intermediate module having a surface thereat and a plurality of openings therein, first and second ones of said openings being connected at ends of different ones of said tunnel segments and a third one of said openings for receiving an intermediate access way structure thereat, said intermediate access way structure being positioned angularly relative to said covered structure and having first and second access openings for ingress and egress therefrom, said intermediate access way structure being connected with said covered structure with one of said access openings corresponding to said third opening of said intermediate module.

* * * * *